US009692107B2

(12) United States Patent
Liu et al.

(10) Patent No.: US 9,692,107 B2
(45) Date of Patent: Jun. 27, 2017

(54) ANTENNA STRUCTURE AND WIRELESS COMMUNICATION DEVICE USING THE SAME

(71) Applicants: SHENZHEN FUTAIHONG PRECISION INDUSTRY CO., LTD., Shenzhen (CN); FIH (Hong Kong) Limited, Kowloon (HK)

(72) Inventors: Xiao-Kai Liu, Shenzhen (CN); Chang-Hai Gu, Shenzhen (CN); Yao-Yao Qin, Shenzhen (CN); Jing-Hai Zheng, Shenzhen (CN)

(73) Assignees: SHENZHEN FUTAIHONG PRECISION INDUSTRY CO., LTD., Shenzhen (CN); FIH (HONG KONG) LIMITED, Kowloon (HK)

( * ) Notice: Subject to any disclaimer, the term of this patent is extended or adjusted under 35 U.S.C. 154(b) by 325 days.

(21) Appl. No.: 14/487,394

(22) Filed: Sep. 16, 2014

(65) Prior Publication Data

US 2015/0155615 A1 Jun. 4, 2015

(30) Foreign Application Priority Data

Nov. 30, 2013 (CN) ..... 2013 1 0622457

(51) Int. Cl.

| | |
|---|---|
| ***H01Q 1/24*** | (2006.01) |
| ***H01Q 21/00*** | (2006.01) |
| ***H01Q 21/30*** | (2006.01) |
| ***H01Q 5/378*** | (2015.01) |

(52) U.S. Cl.

CPC ..... *H01Q 1/243* (2013.01); *H01Q 5/378* (2015.01); *H01Q 21/00* (2013.01); *H01Q 21/30* (2013.01)

(58) Field of Classification Search

CPC ..... H01Q 1/243; H01Q 21/30; H01Q 5/378; H01Q 21/00

USPC ..... 343/702, 700 MS

See application file for complete search history.

(56) References Cited

U.S. PATENT DOCUMENTS

| | | | | |
|---|---|---|---|---|
| 2013/0307736 | A1* | 11/2013 | Larsen | H01Q 1/243 343/702 |
| 2013/0335275 | A1* | 12/2013 | Sanford | H01Q 1/243 343/702 |
| 2014/0285384 | A1* | 9/2014 | Hong | H01Q 5/371 343/702 |
| 2014/0306848 | A1* | 10/2014 | Hong | H01Q 1/243 343/702 |
| 2015/0009092 | A1* | 1/2015 | Chen | H01Q 1/243 343/893 |

FOREIGN PATENT DOCUMENTS

| | | | |
|---|---|---|---|
| CN | 102856645 | A | 1/2013 |
| CN | 103219585 | A | 7/2013 |
| TW | 200835046 | A | 8/2008 |
| TW | 201218504 | A | 5/2012 |
| TW | 201223407 | A | 6/2012 |

* cited by examiner

*Primary Examiner* — Hoanganh Le
(74) *Attorney, Agent, or Firm* — Steven Reiss

(57) ABSTRACT

An antenna structure includes a first carrier, a second carrier and an antenna main body. The antenna main body includes a main antenna and a sub antenna. The main antenna is printed on the first carrier, the sub antenna is printed on the second carrier. The present invention also provides a wireless communication device using the antenna structure.

12 Claims, 5 Drawing Sheets

ANTENNA STRUCTURE AND WIRELESS COMMUNICATION DEVICE USING THE SAME

FIELD

The subject matter herein generally relates to an antenna structure and a wireless communication device using the antenna structure.

BACKGROUND

Metal housings are widely used for electronic devices.

BRIEF DESCRIPTION OF THE DRAWINGS

Implementations of the present technology will now be described, by way of example only, with reference to the attached figures.

DETAILED DESCRIPTION

Figure 1:
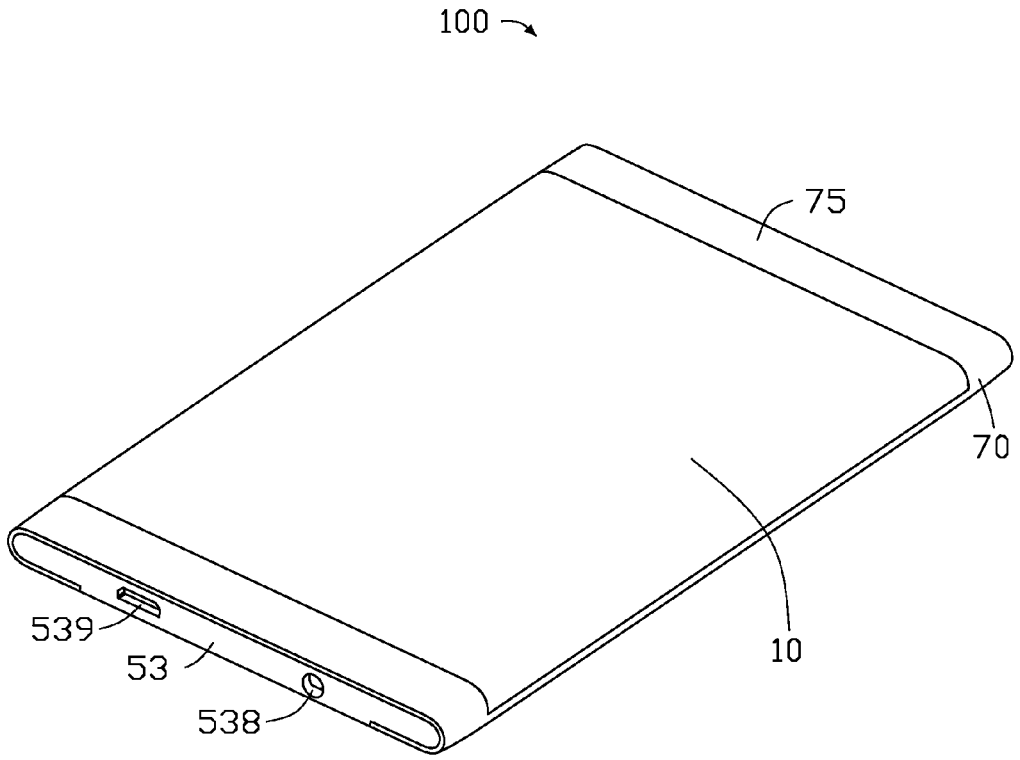
FIG. 1 is an isometric view of a wireless communication device having an antenna structure according to an exemplary embodiment.

FIG. 1 illustrates a wireless communication device 100 according to an exemplary embodiment. The wireless communication device 100 can be a mobile phone or a personal digital assistant.

Figure 2:
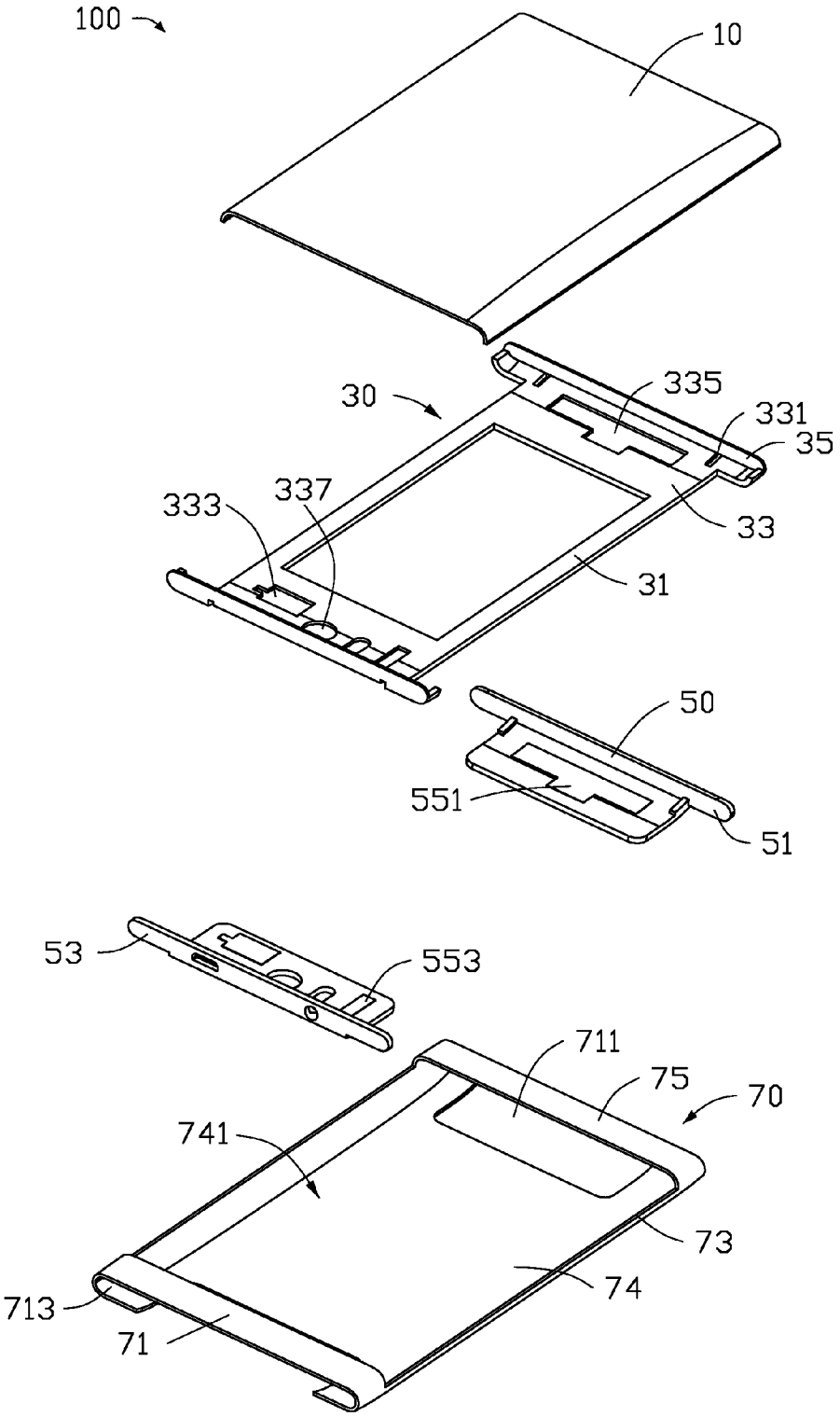
FIG. 2 is an exploded, isometric view of the wireless communication device shown in FIG. 1.

FIG. 2 illustrates that the wireless communication device 100 includes a top housing 10, a supporter 30, an antenna structure 50 attached on the supporter 30, and a bottom housing 70 detachably mounted on the top housing 10. The supporter 30 can be received in the bottom housing 70. The antenna structure 50 is sandwiched between the supporter 30 and the bottom housing 70. In at least one embodiment, the top housing 10 can be made of glass.

In at least one embodiment, the supporter 30 can be made of a plastic. The supporter 30 includes two opposite connecting arms 31, two opposite end portions 33 and two opposite side portions 35. Each of the connecting arms 31 is connected to the two end portions 33. The two side portions 35 are connected to the two end portions 33, respectively. Each of the junctions of the end portions 33 and the side portions 35 defines a slot 331. The slots 331 can be used to fix the antenna structure 50. One end portion 33 defines a first aperture 333 and two through holes 337. Another end portion 33 defines a second aperture 335. The through holes 337 can be used to receive a camera (not shown) and a flash lamp (not shown), respectively.

Figure 3:
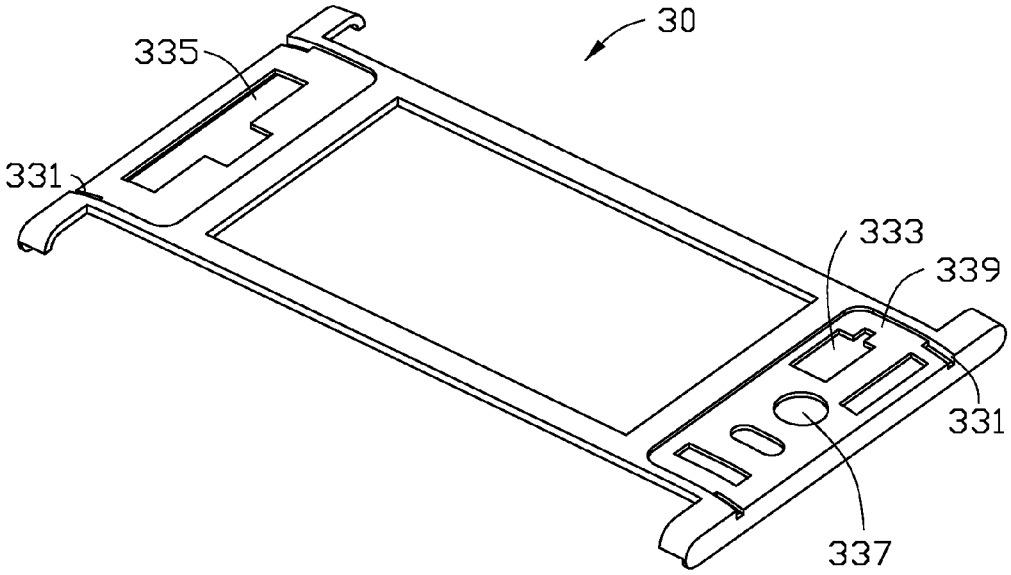
FIG. 3 is similar to FIG. 2, but shown from another angle.

Referring to FIGS. 2-3, each of the surfaces of the two side portions 33 facing the bottom housing 70 defines two grooves 339. The grooves 339 can be positioned on the two opposite ends of the side portions 33, respectively. The grooves 339 can be used to receive the antenna structure 50.

Figure 4:
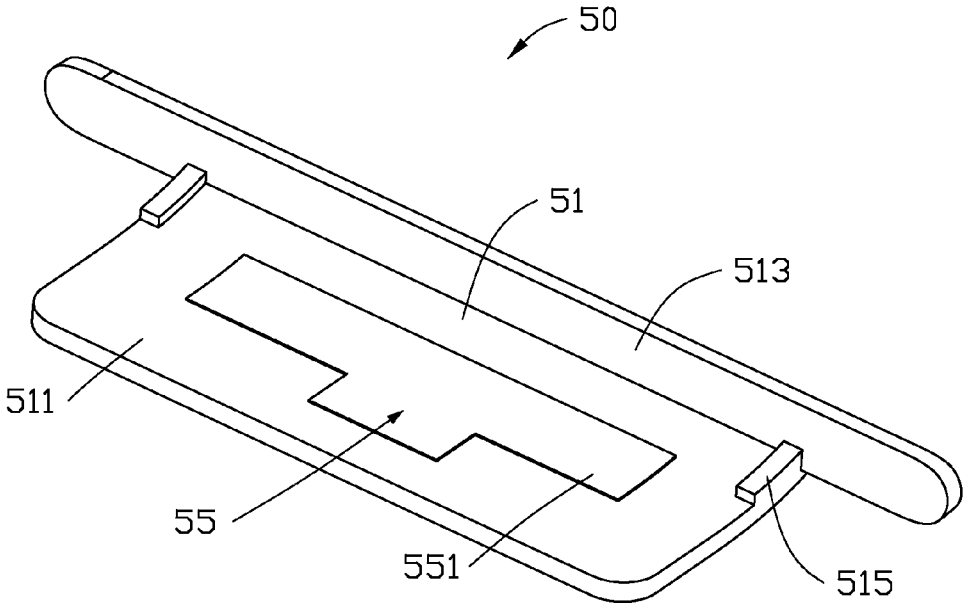
FIG. 4 is an isometric view of an antenna structure of the wireless communication device according to an exemplary embodiment.
Figure 5:
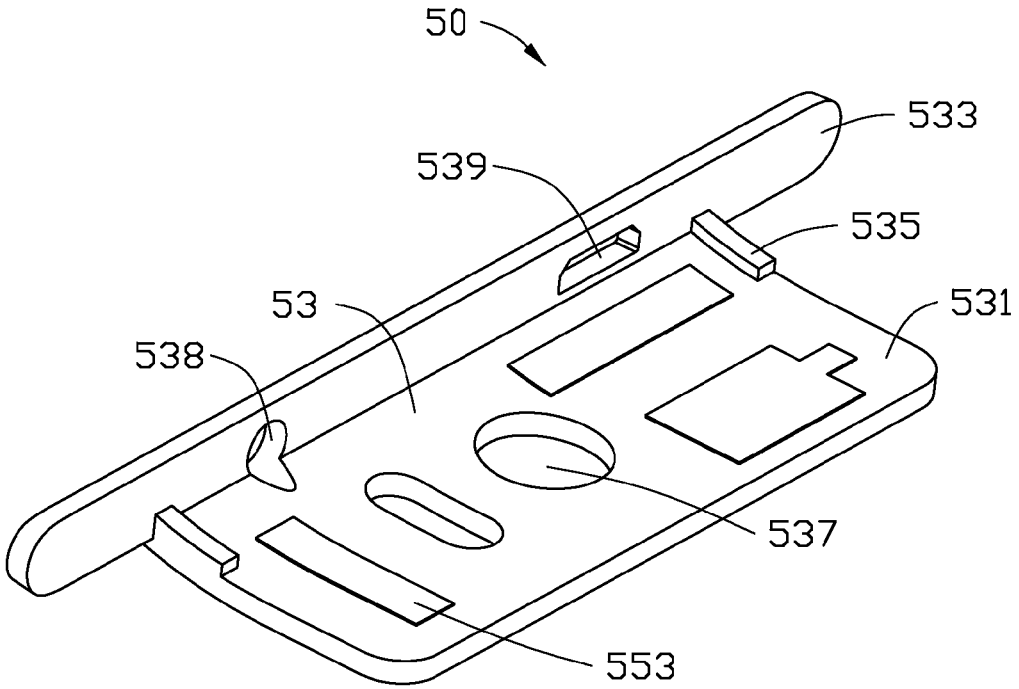
FIG. 5 is an isometric view of an antenna structure of the wireless communication device according to another exemplary embodiment.

Referring to FIGS. 4-5, the antenna structure 50 includes a first carrier 51, a second carrier 53 facing the first carrier 51, and two antenna main bodies 55. The antenna main bodies 55 can be formed on the first carrier 51 and the second carrier 53, respectively.

In at least one embodiment, the first carrier 51 can be made of a ceramic. The first carrier 51 includes a first plate 511, a first end wall 513 protruding from the first plate 511, and two first locating members 515. The first end wall 513 is perpendicularly located at one end of the first plate 511. The junctions of the first plate 511 and the first end wall 513 define the two first locating members 515.

In at least one embodiment, the second carrier 53 can be made of a ceramic. The second carrier 53 includes a second plate 531, a second end wall 533, and two second locating members 535. The second end wall 533 is perpendicularly located at one end of the second plate 531. The junctions of the second plate 531 and the second end wall 533 define the two second locating members 535.

The second plate 531 has the same shape and size as the first plate 511. The second plate 531 has two engagement holes 537, the engagement holes 537 can be used to receive a camera (not shown) and a flash lamp (not shown), respectively.

The two opposite ends of the second end wall 533 define an earphone jack 538 and a USB slot 539, respectively. The earphone jack 538 can be used to receive an earphone (not shown). The USB slot 539 can be used to receive a memory device, such as a USB disk.

The shape of the antenna main body 55 can be changed according to the demand of the wireless communication device 100. The antenna main body 55 includes a main antenna 551 and a sub antenna 553.

The main antenna 551 can be printed on the first plate 511, and electrically connected with the circuit board (not shown) through the second apertures 335 of the supporter 30. The main antenna 551 plays the main role of the antenna structure 50.

The sub antenna 553 includes a WIFI antenna (not shown), a GPS antenna (not shown), and a BLUETOOTH™ antenna (not shown). The sub antenna 553 can adjust the frequency of the antenna structure 50. The sub antenna 553 is printed on the second plate 531 of the second carrier 53, and electrically connected with the circuit board (not shown) through the first apertures 333 of the supporter 30. The position of the sub antenna 553 can be changed according to the demand of the wireless communication device 100.

The bottom housing 70 can be made of a metal. The bottom housing 70 includes a main housing 71. The main housing 71 is tubular shaped and defines a receiving space 713, the receiving space 713 can be used to receive the supporter 30, the circuit board (not shown) and the antenna structure 50. The main housing 71 further includes two opposite curved walls 73, and two opposite body walls 74 connected with the curved walls 73. The two curved walls 73 and two body walls 74 cooperatively form the receiving space 713. The body wall 74 adjacent to the top housing 10 defines an opening 741, thereby forms two opposite upper edges 75. The opening 741 is rectangular shaped. The opening 741 has the same shape and size as the top housing 10. Another body wall 74 defines two cutouts 711. The two cutouts 711 can be formed at the two opposite ends of the body wall 74, respectively. The cutouts 711 have the same shape and size as the first plate 511 and the second plate 531.

When assembling the wireless communication device 100, the antenna structure 50 can be received in spaces cooperatively formed by the cutouts 711 and the grooves 339. The engagement holes 537 of the second carrier 53 correspond to the through holes 337 of the side portions 33. The first locating members 515 and the second locating members 535 are all located in the slots 331 of the side portions 33, respectively. The supporter 30 is mounted in the bottom housing 70. The upper edges 75 stand above the supporter 30. The two side portions 35 are attached on the first end wall 513 and the second end wall 533, respectively. The top housing 10 is mounted in the opening 741 of the bottom housing 70. The two ends of the top housing 10 are seamlessly and detachably connected to the upper edges 75.

In at least one embodiment, the circuit board is mounted in the supporter 30, and electrically connected with the antenna structure 50. The wireless communication device 100 further includes a display member (not shown) located between the top housing 10 and the circuit board.

It is believed that the exemplary embodiments and their advantages will be understood from the foregoing description, and it will be apparent that various changes may be made thereto without departing from the scope of the disclosure or sacrificing all of its material advantages, the examples hereinbefore described merely being preferred or exemplary embodiments of the disclosure.

What is claimed is:

1. An antenna structure, comprising:

a first carrier, the first carrier comprising a first plate, a first end wall protruding from the first plate, and two first locating members, wherein the first end wall is perpendicularly located at one end of the first plate, and the junctions of the first plate and the first end wall define the first locating members;

a second carrier;

an antenna main body, comprising a main antenna and a sub antenna, the main antenna being located on the first carrier, and the sub antenna being located on the second carrier.

2. The antenna structure of claim 1, wherein the second carrier includes a second plate, a second end wall protruding from the first plate, and two second locating members, the second end wall is perpendicularly located at one end of the second plate, and the junctions of the second plate and the second end wall define the second locating members.

3. The antenna structure of claim 1, wherein the first carrier and the second carrier are made of a ceramic.

4. A wireless communication device, comprising:

a top housing;

a supporter, the supporter comprising an end portion and an side portion protruding from the end portion, the two opposite ends of the end portion defining a slot, respectively;

a bottom housing mounted on the top housing, the supporter being mounted in the bottom housing; and an antenna structure, comprising a first carrier, a second carrier and an antenna main body, the antenna main body comprising a main antenna and a sub antenna, the main antenna being located on the first carrier, and the sub antenna being located on the second carrier, the antenna structure being sandwiched between the supporter and the bottom housing;

wherein the first carrier comprises a first plate, a first end wall, and two first locating members, the first end wall is perpendicularly located at an end of the first plate, the junctions of the first plate and the first end wall define the first locating members, and the slots are detachably connected with the first locating members.

5. The wireless communication device of claim 4, wherein the wireless communication device further includes a circuit board, the circuit board is located on the supporter, the antenna structure is electrically connected with the circuit board through the supporter.

6. The wireless communication device of claim 4, wherein the first carrier and the second carrier are all made of a ceramic.

7. The wireless communication device of claim 4, wherein the supporter further includes an another end portion, an another side wall protruded from the another end portion, the two opposite ends of the another end portion define a slot, respectively; the second carrier includes a second plate, a second end wall, and two second locating members, the junctions of the second plate and second end wall define the second locating members, and the slots are detachably connected with the second locating members.

8. The wireless communication device of claim 7, wherein each of the surfaces of the end portions facing the bottom housing defines two grooves, the grooves can receive the first carrier and the second carrier.

9. The wireless communication device of claim 7, wherein the bottom housing includes two opposite curved walls and two opposite body walls connected with the curved walls, the body walls and the curved wall cooperatively form a receiving space, the receiving space is used to receive the supporter, the circuit board and the antenna structure, both ends of one body wall define a cutout, the cutouts are used to receive the first plate and the second plate.

10. The wireless communication device of claim 9, wherein the antenna structure can be received in spaces cooperatively form by the cutouts and the grooves.

11. The wireless communication device of claim 9, wherein another body wall of the bottom housing defines an opening, the opening has the same shape and size as the top housing, and is used to receive the top housing.

12. The wireless communication device of claim 4, wherein the top housing is made of glass, the supporter is made of a plastic.

* * * * *